US008490887B2

(12) United States Patent
Jones

(10) Patent No.: US 8,490,887 B2
(45) Date of Patent: Jul. 23, 2013

(54) RAILROAD RAIL HAVING THERMAL INSULATION BELOW THE RAILHEAD EITHER COATED IN THE FIELD OR AT THE RAIL PRODUCTION FACILITY

(76) Inventor: Paul Jones, La Grange, IL (US)

( * ) Notice: Subject to any disclaimer, the term of this patent is extended or adjusted under 35 U.S.C. 154(b) by 318 days.

(21) Appl. No.: 11/585,441

(22) Filed: Oct. 24, 2006

(65) Prior Publication Data

US 2007/0090201 A1 Apr. 26, 2007

Related U.S. Application Data

(60) Provisional application No. 60/729,687, filed on Oct. 24, 2005.

(51) Int. Cl.
*E01B 11/00* (2006.01)

(52) U.S. Cl.
USPC ..... 238/152

(58) Field of Classification Search
USPC ..... 238/122, 151, 152, 153, 161.5, 162
See application file for complete search history.

(56) References Cited

U.S. PATENT DOCUMENTS 3,727,838 A * 4/1973 Bergh ..... 238/152
4,292,110 A * 9/1981 Marteness ..... 156/92

* cited by examiner

*Primary Examiner* — R. J. McCarry, Jr.
(74) *Attorney, Agent, or Firm* — James Ray & Assoc.

(57) ABSTRACT

A railroad rail having superior thermal expansion characteristics. Such railroad rail comprising a rail having a predetermined weight and a predetermined length and a ceramic based insulating type paint having a predetermined capability of resisting heat buildup in such rail adhered to predetermined areas of such rail.

19 Claims, 1 Drawing Sheet

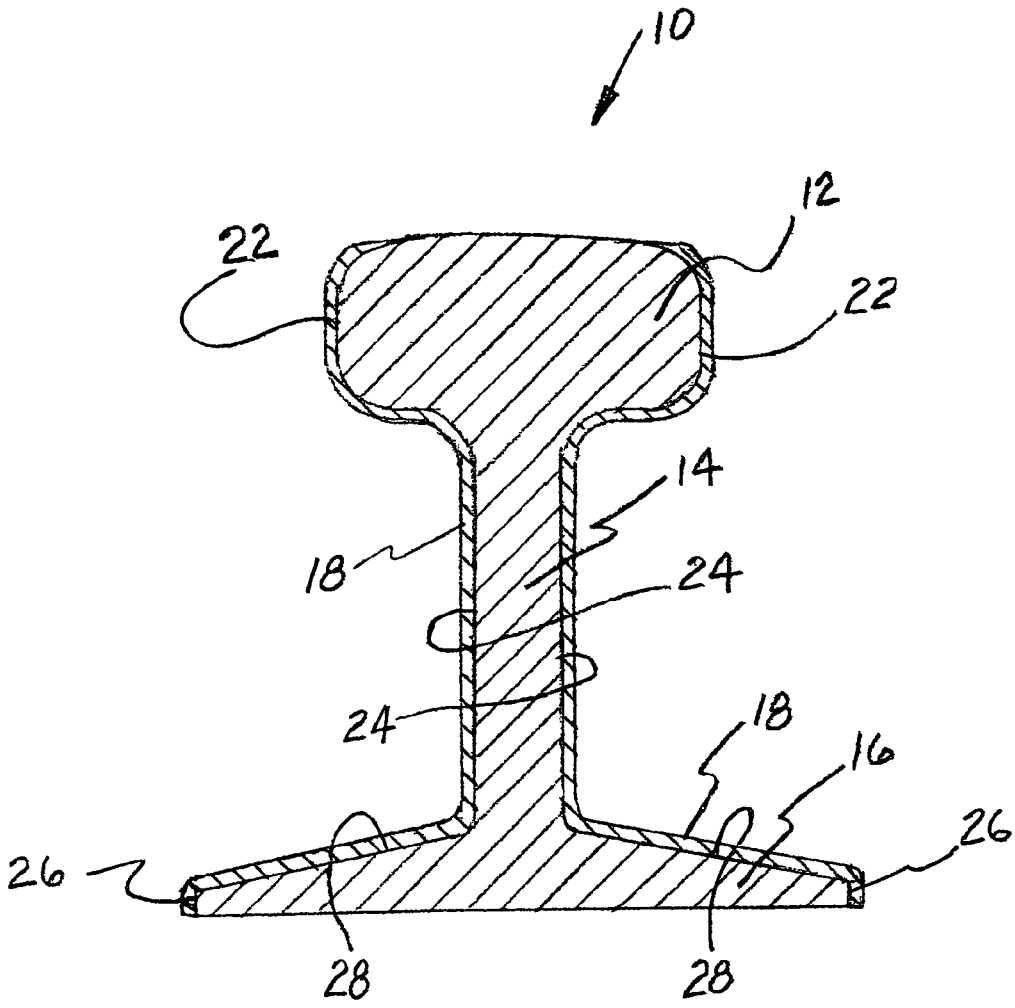
10
12
22
22
14
18
24
24
18
16
26
26
28
28

RAILROAD RAIL HAVING THERMAL INSULATION BELOW THE RAILHEAD EITHER COATED IN THE FIELD OR AT THE RAIL PRODUCTION FACILITY

CROSS REFERENCE TO RELATED APPLICATIONS

This patent application is both related to and claims priority from U.S. Provisional Patent Application Ser. No. 60/729,687 filed Oct. 24, 2005.

FIELD OF THE INVENTION

The present invention relates, in general, to railroad rails including the thermal expansion of such railroad rails and, more particularly, this invention relates to a method of significantly reducing the detrimental thermal expansion of the existing railroad rails and further to a method of producing a new railroad rail having an improved resistance to such thermal expansion.

BACKGROUND OF THE INVENTION

As is generally well known in the railway industry art, during hot weather, particularly in certain areas of the country, railroad rails will expand and depending upon the degree of such expansion they can buckle. Such buckling can cause a number of difficulties not the least of which is derailment of a train running of such rails. These derailments are not only costly to the railroads due to equipment damage but also such derailments can cause a number of serious injuries or even death, as for example, when such derailment involves a passenger train.

As has been reported, track buckling is formation of large lateral misalignments in continuous welded rail (CWR) track, often resulting in catastrophic these derailments. Both curved and tangent tracks are susceptible to buckling with typical curve buckle amplitudes ranging from 6"-14" and tangent buckles from 12"-28". Buckles are typically caused by a combination of three major factors: high compressive forces, weakened track conditions, and vehicle loads (train dynamics).

Compressive forces result from stresses induced in a constrained rail by temperature above its "stress free" state, and from mechanical sources such as braking, rolling friction and wheel flanging on curves. The temperature of the rail at the "stress-free" state is known as the rail neutral temperature (i.e. the temperature at which the rail experiences zero longitudinal force). Initially, the rail's installation temperature or "anchoring temperature" is the rail's neutral temperature. Hence, at rail temperatures above the neutral, compressive forces are generated, and at temperatures below the neutral, tensile forces are developed. Track maintenance practices address the high thermal load problem by anchoring the rail at (neutral) temperature of 95-110° F. This high neutral temperature range prevents the generation of excessively high buckling forces even when the rail temperatures reach 130-150° F.

Another significant problem that can be attributed to such rail expansion is that it will oftentimes cause the railroad ties supporting the rails to shift and thereby loosen the ballast around the ties. This situation occurs because the rails and tie plates which support such rails are secured to the ties in a relatively tight fashion. The shifting of ties can also contribute to derailments and will at least add significantly to the cost of maintaining the track bed in a serviceable condition.

Weakened track conditions impacting the tracks buckling potential include: reduced track Resistance, lateral alignment defects, and lowered rail neutral temperature. Track resistance is the ability of the ballast, ties and fasteners to provide lateral and longitudinal strength to maintain track stability. Resistance is lowered if ballast is missing from under the ties, in the crib or from the shoulder. A full ballast section is important, especially on curves. Adequate ballast in the high side in curves should be on the order of 12"-18" to provide adequate lateral strength. Ballast on the low side is important because inward (pulling-in) movement in cold weather could lead to line defects and lowering of neutral temperature which could lead to a buckle when higher temperature rises occur in early spring. Track resistance is also lowered when ballast is disturbed. Surfacing, tie renewal and undercutting operations will weaken ballast resistance by as much as 40%-60% of undisturbed track. It is a usual industry practice to restrict train speed to minimize train forces while ballast strength is being restored either by traffic or by mechanical consolidation means. Longitudinal resistance offered to the rail/tie structure by adequate rail anchoring is important to prevent rail running and hence the decrease of rail neutral temperature.

Lateral alignment defects also reduce the track's buckling strength because buckles tend to initiate at alignment deviations. The larger the line defect, the more buckling prone the track will be. Alignment errors must be corrected in hot weather and in early spring when curves tend to realign themselves from a winter "pull-in" condition. Buckles can also initiate at bad, crooked welds.

Maintaining a stable and high rail neutral temperature is critical for buckling prevention. Neutral or force-free temperature of CWR is usually different from initial installation or anchoring temperature. This difference is attributed to several factors, including rail longitudinal movement, track lateral shift/radial breathing in curves, track vertical settlement, and maintenance activities. Rail longitudinal movement (creep) is due to train braking and traction forces, or to differential thermal forces (sun and shade). Track lateral shift can be caused by excessive truck hunting, and by lateral forces generated by curving or by lateral misalignments. Compressive and tensile forces can cause radial breathing of curves especially in weak ballast conditions. Vertical differential settlement of rails can occur on new or recently surfaced track, or in areas of weak subgrade conditions. Maintenance operations influencing neutral temperature changes include: lifting, lining, and tamping, replacing broken rail, de-stressing, and installing CWR in cold weather. Research to date has shown that typical CWR rail installation (stress-free) temperatures of 100° F. can reduce in service to 50-60° F. due to these effects.

Track buckles usually initiate at small alignment deviations. Wheel loads and train action (dynamic uplift wave) tend to increase its size to levels which trigger the buckling process. Most buckling derailments tend occur deep in a train. Vehicles contribute to buckling by exerting lateral wheel forces in a curve. Lateral forces can also occur in tangent track from car movement caused by line or surface deviations or track hunting. The track must absorb this energy. Slack action, heavy dynamic braking and emergency brake applications can trigger a buckle. It is important to inspect track after a train passage in hot weather, especially if the track has recently been disturbed.

The above is a brief summary of the track buckling problem in terms of the three major causal factors: high compressive forces, weakened track conditions, and vehicle loads (train dynamics).

Over one five year period of time, from 1997 to 2002, statistics indicate an average of 38 derailments a year with an increasing yearly damage level to as high as $17 million in 2002. Currently there are no FRA safety performance standards in place addressing CWR buckling safety.

It has been further reported that as the temperature rises above preselected temperatures the train speed must be lowered and in some cases trains can only run at night.

In one prior art type effort to alleviate this situation, which is known to applicant, the rails were painted white in order to decrease the amount of heat being absorbed by such rails. Although this did improve somewhat the resistance of the painted rails to heating up it was not entirely successful, however, because such paint became covered with grease and grime due to nature of the outdoor environment such rails are exposed too.

SUMMARY OF THE INVENTION

In a first embodiment, the present invention provides a method of reducing the heat absorption of an installed rail on a track structure in order to decrease the amount of expansion exhibited by the rail. The method at least includes the steps of selecting a ceramic based insulating type paint having a predetermined capability of resisting heat buildup in such rail. Any loose dirt and/or grime must be removed from the surface of at least certain predetermined portions of such rail and thereafter applying the ceramic based insulating type paint selected to such predetermined portions of the rail having such loose dirt and/or grime removed therefrom.

In a second embodiment, the present invention provides a method of forming a heat resistant rail prior to its installation in a track structure. Such method includes the steps of selecting a ceramic based insulating type paint having a predetermined capability of resisting heat buildup in such rail. Removing any rolling oil and/or other existing contaminants from a surface area of at least certain predetermined portions of the rail. Applying such ceramic based insulating type paint selected to such predetermined portions of the rail having such rolling oil and/or other contaminants removed therefrom and thereafter installing such rail in a track structure.

In a third embodiment, the present invention provides an improved rail having superior thermal expansion characteristics. The improved rail includes a rail having a predetermined weight and a predetermined length and a ceramic based insulating type paint having a predetermined capability of resisting heat buildup in such rail adhered to predetermined areas of such rail.

OBJECTS OF THE INVENTION

It is, therefore, one of the primary objects of the present invention to provide a method of decreasing the thermal expansion of a rail.

Another object of the present invention is to provide a method of decreasing the thermal expansion of a rail which will be cost effective due to a reduction in the cost of maintaining the track.

Still another object of the present invention is to provide a method of decreasing the thermal expansion of a rail which can potentially provide fewer derailments caused by buckling of a rail and the cost associated therewith.

Yet another object of the present invention is to provide a method of decreasing the thermal expansion of a rail which can be retrofitted to rail already disposed in a track structure.

An additional object of the present invention is to provide a method of decreasing the thermal expansion of a rail which can be accomplished while a track in still in service.

A further object of the present invention is to provide a rail having an improved capability to resist thermal expansion and thereby resist buckling during service.

In addition to the various objects and advantages of the present invention which have been described with some degree of specificity above, it should be obvious that those persons who are skilled in the relevant art can envision numerous other objects and advantages of the instant invention from the following more detailed description, particularly, when such description is taken in conjunction with the attached drawing Figures and with the appended claims.

BRIEF DESCRIPTION OF THE DRAWING

FIG. 1 is a cross sectional view of a presently preferred embodiment of the invention.

BRIEF DESCRIPTION OF A PRESENTLY PREFERRED AND VARIOUS ALTERNATIVE EMBODIMENTS OF THE INVENTION

According to a first embodiment of the invention, there is provided a method of reducing the heat absorption of a rail installed as part of a track structure. By reducing such heat absorption there is a decrease in the detrimental expansion of the rail achieved.

The method includes selecting a ceramic based insulating type paint having a predetermined capability of resisting heat buildup in such rail. The presently preferred ceramic based insulating paint is one presently manufactured and marketed by Superior Products International, Inc. under the Trademark Super Therm®. This particular paint product has four different ceramic materials to achieve its enhanced insulating capability. Each of these four ceramics provide certain preselected desirable characteristics to the insulating paint. These characteristics include heat reflection, dead air space and blocking of infrared rays. Additionally, as shown in a 180 degree bending test, this particular ceramic based insulating paint exhibits excellent bending properties thereby ensuring enhanced life.

Another step in the method involves removing any and all loose dirt and/or other contaminants from a surface area of at least certain predetermined portions of such rail to be coated. It is presently preferred that the surface area to be coated will be cleaned by power washing.

After all the loose dirt and other contaminants have been removed from the rail the final step in the method involves applying a predetermined thickness of the ceramic based insulating type paint selected to the predetermined portions of the rail. Such predetermined thickness of the coating will be at least about 13 mils thick in a wet state and in the presently preferred embodiment of the invention such predetermined thickness of the coating will be at least about 16 mils thick in a wet state.

In a test installation, it has been demonstrated that the temperature of the rail can be reduced by about 34° F. when the rail has been coated as described above.

According to a second embodiment, the present invention provides a method of forming a heat resistant rail to be installed in a track structure at the rail manufacturing facility. This method includes the steps of selecting a ceramic based insulating type paint, as described above, having a predetermined capability of resisting heat buildup in the rail to be coated with such paint. The ceramic based insulating type paint selected is effective in blocking heat from each of radiation, convection and conduction. In addition, the ceramic based insulating type paint selected should be non toxic.

The method also requires removing any rolling oil and other contaminants from a surface area of at least certain predetermined portions of such rail prior to coating.

Thereafter, applying such ceramic based insulating type paint selected to the predetermined portions of such rail and installing such rail pre-coated with such ceramic based insulating type paint selected and applied to such predetermined portions of the rail prior to installation. These certain predetermined portions of the rail include each side of such rail from a top surface of the head of the rail to a bottom surface of the rail flange.

In the presently preferred embodiment of the invention, such rail is coated with the ceramic based insulating type paint selected prior to shipment from the rail mill.

Reference is now made, more particularly, to FIG. 1. Illustrated therein, in yet another embodiment of the present invention, is a rail, generally designated 10, having each of a predetermined weight and a predetermined length. Such rail 10 includes a head portion 12, a web portion 14 and a flange or base portion 16.

In the presently preferred embodiment of the invention, each outer edge 22 of the head portion 12 and each side 24 of the web portion 14 and each exposed side surface 26 and upper surface 28 of the flange portion 16 of the rail 10 have a ceramic based insulating type paint 18, having a predetermined capability of resisting heat buildup in such rail 10, adhered to predetermined areas of rail 10.

It is within the scope of the present invention for the rail to be selected from the group consisting of light rails and standard rails. It is presently preferred for such rail to be a standard rail.

Also within the scope of the present invention for the predetermined shape of the rail to be selected from the group consisting of curved and straight rail. It should be understood that it is particularly important for the curved rail to be protected due to the centrifugal forces being exerted on the outer rail in the track structure.

While in accordance with the patent statues both a presently preferred and a number of alternative embodiments of the invention have been described in such full, clear and concise manner to enable a person skilled in the relevant art to use the same, it should be understood that various other modifications and adaptations can be made without departing from either the spirit of the invention or the scope of the appended claims.

I claim:

1. A method of reducing detrimental heat absorption of an installed rail on a track structure in order to decrease undesirable expansion of such rail, said method comprising the steps of:

(a) selecting a ceramic based insulating paint configured to resist detrimental heat buildup in said rail;

(b) removing substantially all loose dirt and grime from an exterior surface area of at least certain predetermined portions of said rail to be coated with said ceramic based insulating paint selected in step (a); and (c) applying a predetermined thickness of said ceramic based insulating paint, selected in step (a), directly to said exterior surface area of said at least certain predetermined portions of said rail having said substantially all loose dirt and grime removed therefrom in step (b).

2. A method, according to claim 1, wherein step (b) includes power washing.

3. A method, according to claim 1, wherein said predetermined thickness is at least about 13 mils thick in a wet stage.

4. A method, according to claim 3, wherein said predetermined thickness is at least about 16 mils thick in a wet stage.

5. A method, according to claim 1, wherein said ceramic based insulating paint selected in step (a) includes a predetermined number of preselected ceramic materials.

6. A method, according to claim 5, wherein said predetermined number of preselected ceramic materials is four.

7. A method, according to claim 5, wherein said four ceramics provide certain preselected desirable characteristics including heat reflection, dead air space and blocking of infrared rays.

8. A method, according to claim 1, wherein said predetermined portions of said rail having said pre-selected ceramic based insulating paint applied thereto include each side of said rail and a top portion of said rail's flange.

9. A method of forming a heat resistant rail to be installed in a track structure, said method comprising the steps of:

(a) selecting a ceramic based insulating paint configured to resist heat buildup in said rail;

(b) removing any rolling oil and other contaminants from an exterior surface area of at least certain predetermined portions of said rail;

(c) applying said ceramic based insulating paint selected in step (a) to said exterior surface area of said at least certain predetermined portions of said rail having said rolling oil and other contaminants removed therefrom in step (b); and (d) installing said rail having said ceramic based insulating paint selected in step (a) applied to said predetermined portions of said rail having said rolling oil and other contaminants removed therefrom in step (b) in a track structure.

10. A method of forming a heat resistant rail, according to claim 9, wherein step (c) is completed prior to shipping said rail from a rail manufacturing facility.

11. A method of forming a heat resistant rail, according to claim 9, wherein said ceramic based insulating paint selected in step (a) is effective in blocking heat from each of radiation, convection and conduction.

12. A method of forming a heat resistant rail, according to claim 9, wherein said certain predetermined portions of said rail include each side of said rail from a top surface of said rail to a bottom surface thereof.

13. A method of forming a heat resistant rail, according to claim 9, wherein said ceramic based insulating paint selected in step (a) is non toxic.

14. A railroad rail having superior thermal expansion characteristics, said improved railroad rail comprising:

(a) a rail having a predetermined weight, a predetermined length and a predetermined shape; and (b) a ceramic based insulating paint configured to resist heat buildup in said rail, said ceramic based insulating paint adhered to predetermined exterior surface areas of said rail.

15. A railroad rail, according to claim 14, wherein said predetermined shape of said rail is selected from the group consisting of curved and straight.

16. A railroad rail, according to claim 15, wherein said predetermined shape of said rail is curved.

17. A railroad rail, according to claim 14, wherein said predetermined areas of said rail include each side of said rail from a top surface of a head of said rail to an exposed surface of a base of said rail.

18. A method of decreasing undesirable expansion of a rail on a track structure, said method comprising the steps of:

(a) providing a ceramic based paint configured to resist detrimental heat buildup in said rail;

(b) removing substantially all loose dirt and grime from an exterior surface area of at least certain predetermined portions of said rail;

(c) applying said ceramic based paint, provided in step (a), to said exterior surface area of said at least certain predetermined portions of said rail having said substantially all loose dirt and grime removed therefrom in step (b); and (d) reducing, with said ceramic based paint applied in step (c), heat absorption by said rail.

19. A method of decreasing undesirable expansion of a rail on a track structure, said method comprising the steps of:

(a) providing a ceramic based paint;

(b) removing substantially all loose dirt and grime from an exterior surface area of at least certain predetermined portions of said rail;

(c) applying said ceramic based paint, provided in step (a), directly to said exterior surface area of said at least certain predetermined portions of said rail having said substantially all loose dirt and grime removed therefrom in step (b); and (d) reducing, with said ceramic based paint applied in step (c), heat absorption by said rail.

* * * * *